US007210187B2

(12) United States Patent
Liew

(10) Patent No.: US 7,210,187 B2
(45) Date of Patent: May 1, 2007

(54) SET OF PARTS AND AN ARTICLE FOR CLEANING ASSEMBLED THEREFROM

(75) Inventor: Hon Seong Liew, Ipoh (MY)

(73) Assignee: Graduate Group SDN. BHD., Perak (MY)

( * ) Notice: Subject to any disclaimer, the term of this patent is extended or adjusted under 35 U.S.C. 154(b) by 18 days.

(21) Appl. No.: 10/993,597

(22) Filed: Nov. 19, 2004

(65) Prior Publication Data

US 2006/0107477 A1 May 25, 2006

(51) Int. Cl.
*A46B 7/04* (2006.01)

(52) U.S. Cl. ..... 15/172; 15/144.1; 15/145; 15/167.1; 15/176.2

(58) Field of Classification Search ..... 15/143.1, 15/144.1, 145, 167.1, 172, 176.1–176.3, 15/176.6

See application file for complete search history.

(56) References Cited

U.S. PATENT DOCUMENTS 115,040 A * 5/1871 Dunaway ..... 403/4
2,051,687 A * 8/1936 Dressler ..... 15/167.1
2,124,647 A * 7/1938 Bauler ..... 15/167.1
5,809,604 A * 9/1998 Olstyn ..... 15/111

FOREIGN PATENT DOCUMENTS

| | | |
|---|---|---|
| EP | 077869 | * 5/1983 |
| GB | 331126 | * 6/1930 |
| IT | 506632 | * 12/1954 |

* cited by examiner

*Primary Examiner*—Mark Spisich
(74) *Attorney, Agent, or Firm*—Hamre, Schumann, Mueller & Larson, P.C.

(57) ABSTRACT

The disclosure relates to an article for cleaning, such as a toothbrush. The article includes a hand grip part, with a screw-threaded spigot projecting from one end of the hand grip, and a cleaning part having a plurality of screw threaded sockets in each of at least a top, end and side surface of the cleaning part, which are releasably engageable to the spigot. The hand grip, part and the cleaning parts can be assembled in a plurality of different relative positions.

5 Claims, 3 Drawing Sheets

SET OF PARTS AND AN ARTICLE FOR CLEANING ASSEMBLED THEREFROM

Figure 1:
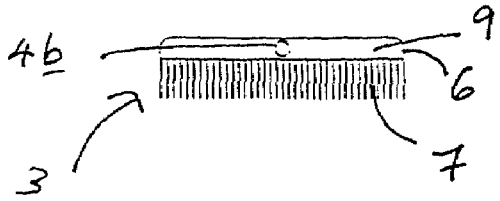
Figure 2:
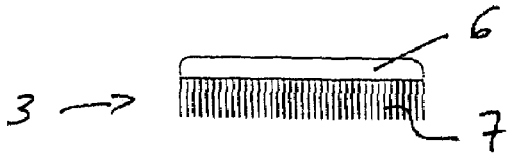

The invention relates to a set of parts and an article assembled therefrom, particularly a cleaning article such as a brush, in particular a toothbrush.

Toothbrushes have hitherto generally comprised a hand grip part and a cleaning part or brush head, the two parts being essentially in line. This can lead to difficulty in cleaning teeth thoroughly as it is difficult to manipulate the hand grip part so that the brush head cannot clean all teeth in a set, which can lead to the formation of plaque, poor oral hygiene, and overall deterioration of teeth. This in turn puts strain on Government Health Services in that additional dental care for the Community has to be provided.

It is accordingly an object of the invention to seek to mitigate these disadvantages.

According to a first aspect of the invention there is provided a set of parts for assembly to provide an article for cleaning, comprising a hand grip part, a cleaning part, and releasably interengageable means for assembly of the parts to form the article, the set being characterised by one part having a plurality of said means whereby the parts can be assembled in a plurality of different relative positions.

The one part may comprise the cleaning part. This provides a relatively simple construction, particularly when the releasably interengageable means may comprise screw thread means.

The screw thread means may comprise a screw-threaded spigot of the handgrip part and a plurality of screw-threaded sockets of the cleaning part. This provides for versatility in assembly to provide the plurality of different positions.

The screw-threaded spigot may comprise an end of the hand grip part remote from a free, in use, end of the hand grip part. This provides a relatively simple construction in that the screw-threaded spigot can be inserted directly into a complementary socket.

The cleaning part may comprise a brush head, particularly a toothbrush head. This provides a relatively simple article for cleaning teeth in a number of different ways, and at different angles.

The toothbrush head may comprise a body which is a substantially rectangular parallelepiped and there may be a socket in each of the two surfaces of the body. This provides for the plurality of different relative assembled positions, particularly when there may be a socket in each of a top, end surface and side surface of the body.

The hand grip part and the cleaning part may be moulded from plastic material. This provides a relatively inexpensive material, and manufacture, particularly when the releasably interengageable means may be formed integrally with the respective hand grip part and cleaning part.

According to a second aspect of the invention there is provided a toothbrush, characterised by being assembled from a set of parts as hereinbefore defined.

A set of parts and a toothbrush embodying the invention are hereinafter described, by way of example, with reference to the accompanying drawings.

FIGS. 1, 2, 7, 8, 13 and 14 show different elevational views of a toothbrush head being a cleaning part of the set, according to the invention, and FIGS. 3 to 6, 9 to 12 and 15 to 18 show how the toothbrush head of FIGS. 1, 2, 7, 8, 13 and 14 is assemblable with a hand grip part of the set to form a toothbrush according to the invention.

Referring to the drawings, there is shown a set of parts 1, for assembly to provide an article for cleaning, in the embodiment a toothbrush, comprising a hand grip part 2, a cleaning part or brush head 3, and releasably interengageable means 4*a*, 4*b* for assembly of the parts 2, 3 to form the toothbrush 5, the set 1 being characterised by one part 3, in the embodiment the brush head, having a plurality of said means 4*b* whereby the parts 2, 3 can be assembled in a plurality of different positions.

The hand grip part 2 is moulded in a suitable material such as plastic and has projecting from one end, the end opposite the free end which is grasped by a hand in use, an externally screw-threaded spigot forming the part 4*a* of the releasably interengageable means 4*a*, 4*b*.

The brush head 3 is also formed as by moulding from a suitable material such as plastic to form a body 6 which is substantially in the form of a rectangular parallelepiped from which project cleaning bristles 7, which can be formed integrally during moulding.

Figure 3:
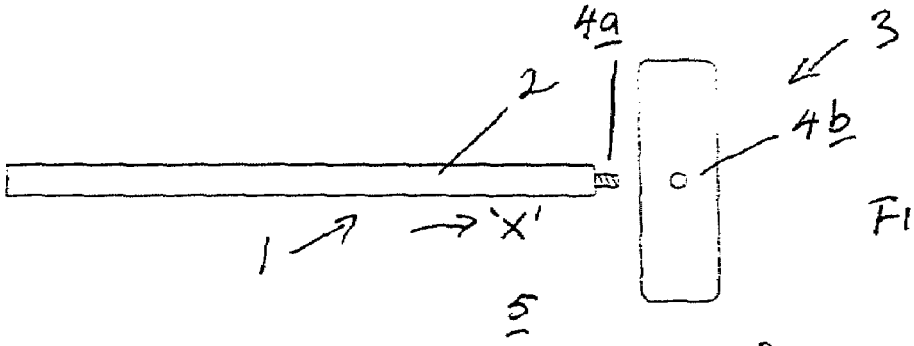
Figure 4:
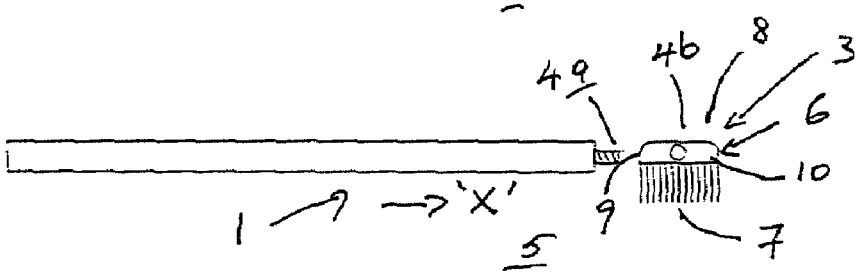
Figure 5:
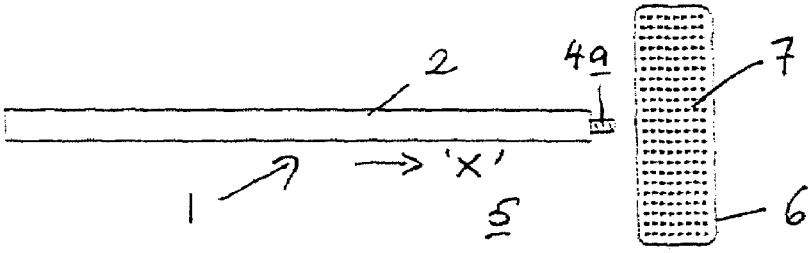
Figure 6:
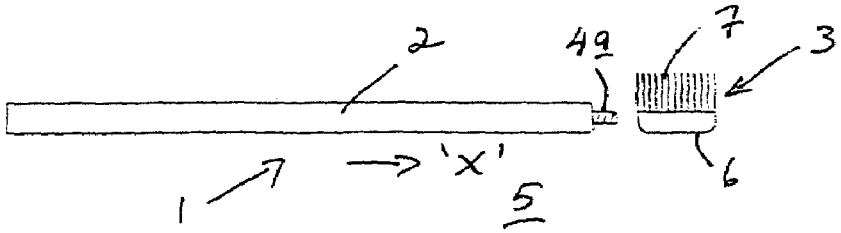
Figure 7:
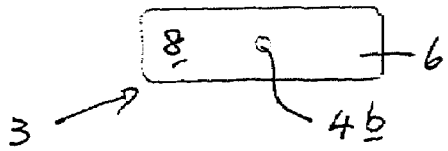
Figure 8:
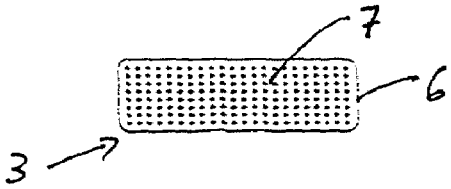

A top 8, side 9 and end face 10 of the body each have a screw-threaded socket forming the part 4*b* of the releasably interengageable means 4*a*, 4*b*. Each socket 4*b* can be formed during moulding, or can be formed thereafter. In either case, the socket 4*b* is complementary to the spigot 4*a* so that the parts 2, 3 can be assembled by screw-engagement of the spigot and socket in the direction of arrow 'X', in a plurality of different relative positions of the hand grip part 2 and brush head 3 to provide different shaped toothbrushes from the one set 1, so that a multi-way or multi-purpose toothbrush 5 can be provided. Thus in FIGS. 3 to 6, the hand grip part 2 can be assembled with the brush head 3 by engagement of the spigot 4*a* in a socket 4*b* in a long-side face 9, so that the brush head 6 is at 90° to the hand grip 2, FIG. 3 showing a plan view, FIG. 4 a side view, FIG. 5 a bottom plan view, and FIG. 6 from the side opposite that of FIG. 3 and with the brush head inverted.

Figure 9:
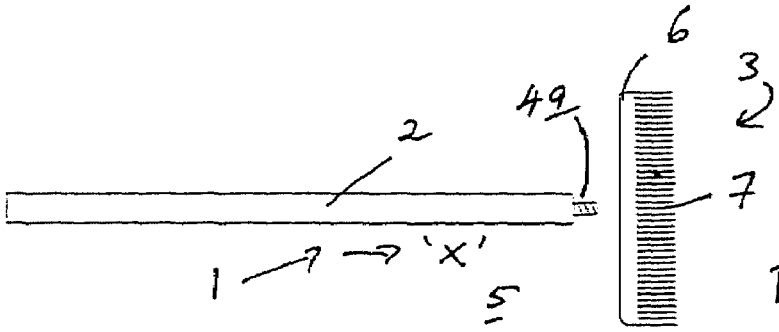
Figure 10:
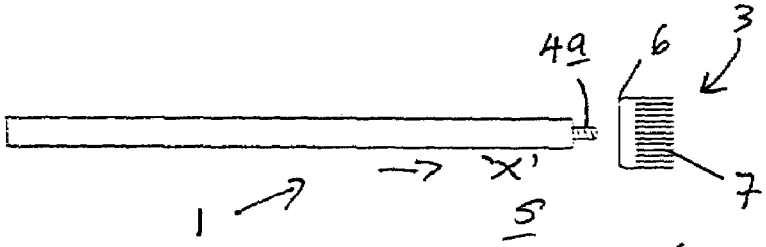
Figure 11:
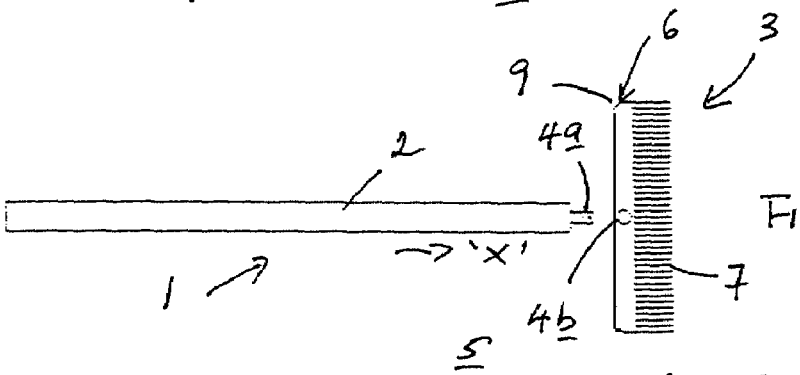
Figure 12:
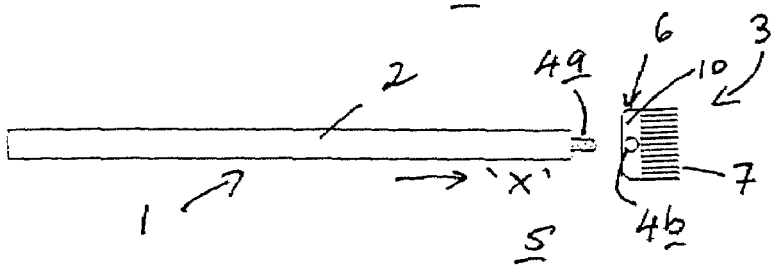
Figure 13:
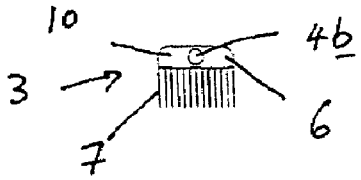
Figure 14:
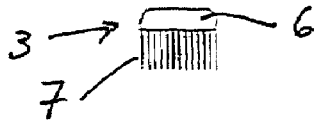

Similarly, FIGS. 9 to 12 show the brush head 3 and hand part 2 assembled with the hand grip part 2 screwed into the socket 4*b* in the top 8 of the body 6 of the brush head 3. FIG. 9 shows a plan view, FIG. 10 an end elevation, FIG. 11 a bottom plan view and FIG. 12 a view from the side opposite that of FIG. 10.

Figure 15:
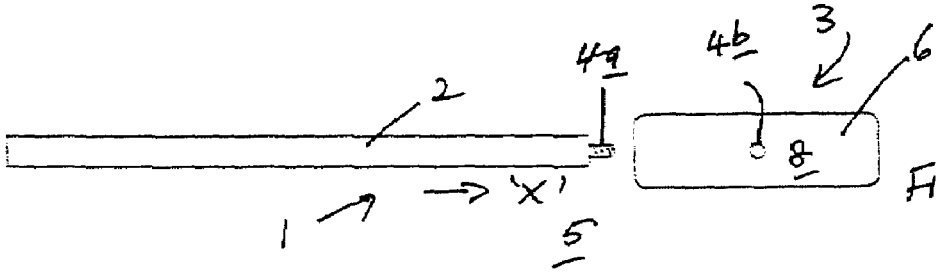
Figure 16:
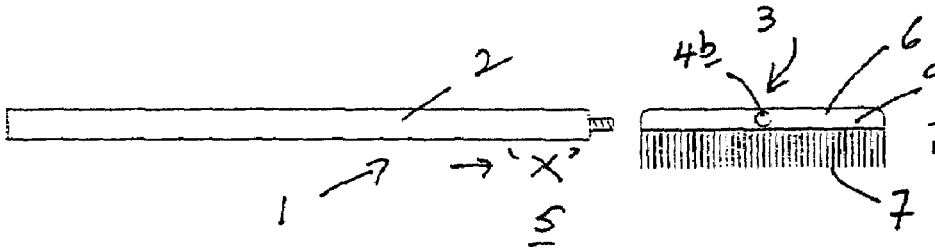
Figure 17:
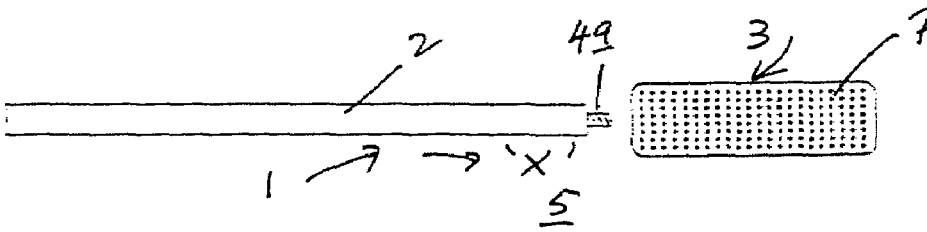
Figure 18:
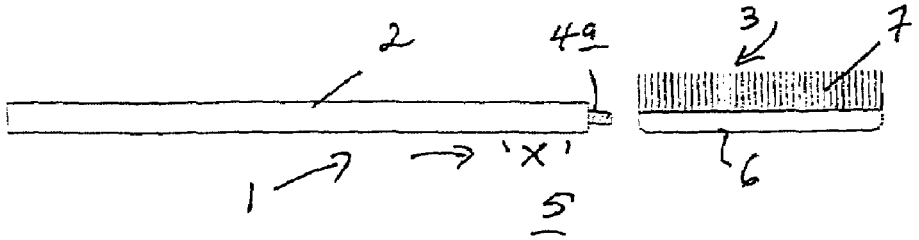

In another assembly position, the hand grip part 2 and brush head 3 are assembled in line, as shown in FIGS. 15 to 18 with the spigot 4*a* being screwed into the socket 4*b* in an end face 10, FIG. 15 being a plan view, FIG. 16 a front view, FIG. 17 a bottom plan view and FIG. 18 a rear view with the toothbrush inverted.

Thus by engaging the brush head 3 and hand grip 2 as shown, a plurality of different relative positions, and thus toothbrush shapes can be provided, and this provides a multi-way toothbrush 5 for cleaning all teeth thoroughly.

It will be understood that modification may be possible. Thus there may be more than one socket 4*b* in a particular surface, for example there may be two or more sockets 4*b* in the top surface 8. This provides versatility as does a further modification where there is a socket 4*b* or sockets 4*b* in every face of the body, i.e. top and opposed side and end faces, except the one from which the bristles 7 project.

Also, the invention as described herein may be used with a brush such as a cleaning brush or other implement.

The invention claimed is:

1. A toothbrush, comprising:

a hand grip;

a toothbrush head;

releasably interengageable means comprising a screw threaded spigot on an end of the band grip and a plurality of screw threaded sockets defined in the toothbrush head, whereby the toothbrush head can be releasably assembled in a plurality of different positions relative to the hand grip; and the toothbrush head comprising an elongated body that is a substantially rectangular parallelepiped, the head including opposed top and bottom surfaces with the bottom surface including a plurality of bristles extending therefrom, opposed sides surfaces extending along the length of the body, and opposed end surfaces, and there being a screw threaded socket in at least the top surface, one of the side surfaces and one of the end surfaces whereby the hand grip and head may selectively assume one of the three orientations including (1) a first orientation wherein the hand grip is substantially parallel to the longitudinal axis of the body when the spigot is engaged with the threaded socket in the end surface, (ii) a second orientation wherein the hand grip is substantially perpendicular to the longitudinal axis of the body when the spigot is engaged with the threaded socket in the side surface, and (iii) a third orientation wherein the hand grip is substantially perpendicular to the top surface and generally aligned with the bristles when the spigot is engaged with the threaded socket in the top surface.

2. The toothbrush according to claim 1, wherein the hand grip and the toothbrush head are moulded from plastic material.

3. The toothbrush according to claim 1, wherein the releasably interengageable means are being formed integrally with the respective hand grip and toothbrush head.

4. The toothbrush according to claim 1, wherein there are more than one sockets defined in at least one planar surface of the body of the toothbrush head.

5. The toothbrush according to claim 1, wherein the hand grip and the toothbrush head are moulded from plastic material, and the releasably interengageable means are formed integrally with the respective hand grip and toothbrush head.

* * * * *